US006186748B1

(12) United States Patent
Umeda et al.

(10) Patent No.: US 6,186,748 B1
(45) Date of Patent: Feb. 13, 2001

(54) AXIAL PISTON PUMP

(75) Inventors: Tokihiko Umeda; Sachio Kawabata; Kazuhide Matsuda, all of Kobe; Ryuji Sakai, Akashi, all of (JP)

(73) Assignee: Kawasaki Jukogyo Kabushiki Kaisha (JP)

( * ) Notice: Under 35 U.S.C. 154(b), the term of this patent shall be extended for 0 days.

(21) Appl. No.: 09/357,093

(22) Filed: Jul. 19, 1999

(30) Foreign Application Priority Data

Jul. 21, 1998 (JP) ..... 10-205421
Feb. 4, 1999 (JP) ..... 11-027747

(51) Int. Cl.[7] ..... F04B 1/12
(52) U.S. Cl. ..... 417/269; 91/6.5
(58) Field of Search ..... 417/269, 270, 417/485; 91/506, 6.5, 485

(56) References Cited

U.S. PATENT DOCUMENTS

| | | | | |
|---|---|---|---|---|
| 4,065,229 | * | 12/1977 | Black | 417/270 |
| 4,075,933 | * | 2/1978 | Stephens | 91/506 |
| 4,373,870 | * | 2/1983 | Pandzik | 417/269 |
| 4,757,743 | * | 7/1988 | Tovey | 91/6.5 |
| 4,920,856 | * | 5/1990 | Berthold et al. | 91/6.5 |
| 5,105,723 | * | 4/1992 | Kazahaya et al. | 91/485 |
| 5,112,198 | * | 5/1992 | Skinner | 417/269 |
| 5,253,983 | * | 10/1993 | Suzuki et al. | 417/485 |
| 5,368,450 | * | 11/1994 | Fujii et al. | 417/269 |
| 5,385,450 | * | 1/1995 | Kimura et al. | 417/269 |
| 5,593,285 | * | 1/1997 | Watts | 417/269 |
| 5,772,406 | * | 6/1998 | Takai | 417/269 |

FOREIGN PATENT DOCUMENTS

| | | | |
|---|---|---|---|
| 29 08 645 U | * | 9/1980 | (DE) . |
| 4035748A1 | * | 5/1991 | (DE) . |
| 0608144B1 | * | 7/1994 | (EP) . |
| 54-044208 | | 4/1979 | (JP) . |
| 210242 | * | 8/1996 | (JP) . |
| 247022 | * | 9/1996 | (JP) . |
| 151840 | * | 6/1997 | (JP) . |
| 280162 | * | 10/1997 | (JP) . |

OTHER PUBLICATIONS

Japanese Publication No. Sho58–120882 Dated Aug. 17, 1983 for Application No. Sho57–16451 Filed Feb. 10, 1982 for Mitsubishi Jukogyo Kabushiki Kaisha (Inventor Ichiro Takeno).

Japanese Publication No. 57032080 A Dated Feb. 20, 1982 for Application No. 55107078 Filed Aug. 6, 1980 for Teijin Seiki Co Ltd. (Inventor Yamada Yoshichika) Patent Abstracts of Japan.

Japanese Publication No. 06026448 A Dated Feb. 1, 1994 for Application No. 03052251 Filed Mar. 18, 1991 for Nissan Motor Co Ltd. (Inventor Shiokawa Shoji) Patent Abstracts of Japan (in Japanese and English).

* cited by examiner

*Primary Examiner*—Teresa Walberg
*Assistant Examiner*—Leonid Fastovsky

(57) ABSTRACT

An axial piston pump has a structure in which an opening of one of the piston chambers starts overlapping with an opening portion when a pressure of another piston chamber reaches a pressure of a discharge port, and an opening of one of the piston chambers starts overlapping with an opening when a pressure of another piston chamber reaches a pressure of a suction port.

17 Claims, 9 Drawing Sheets

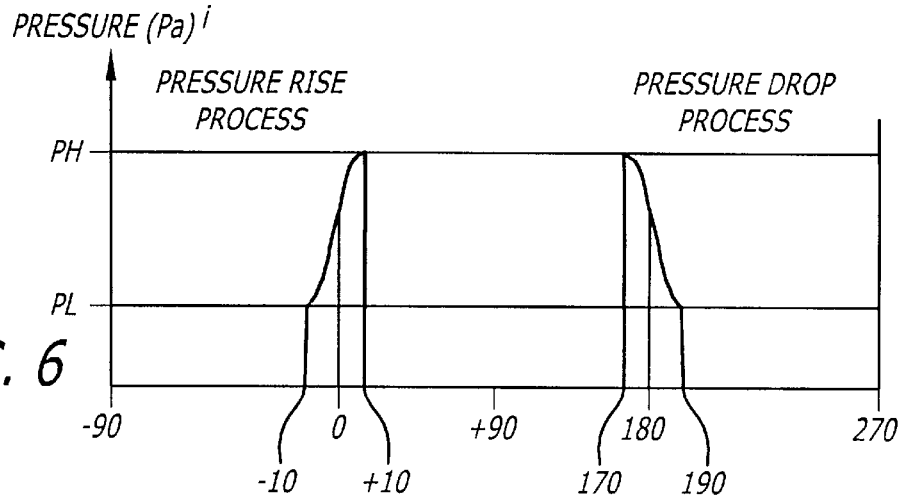
FIG. 6
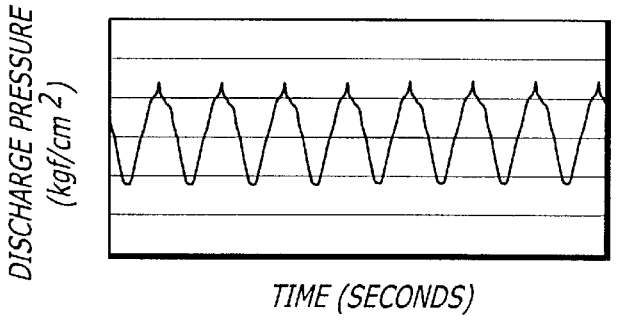
FIG. 9A
FIG. 9B
PRIOR ART
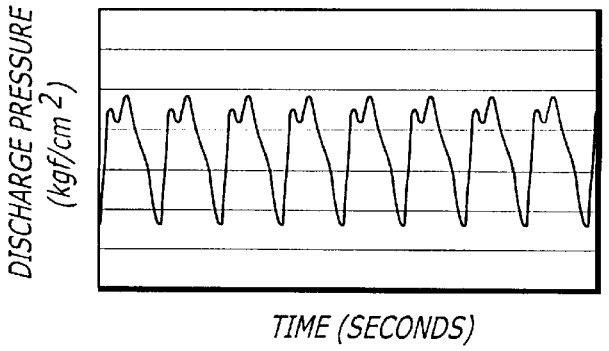

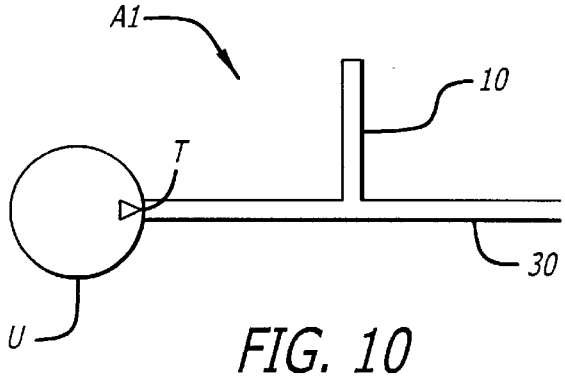
FIG. 10
FIG. 11
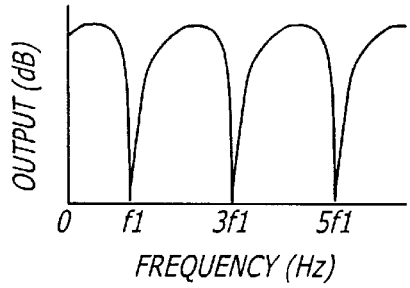
FIG. 12
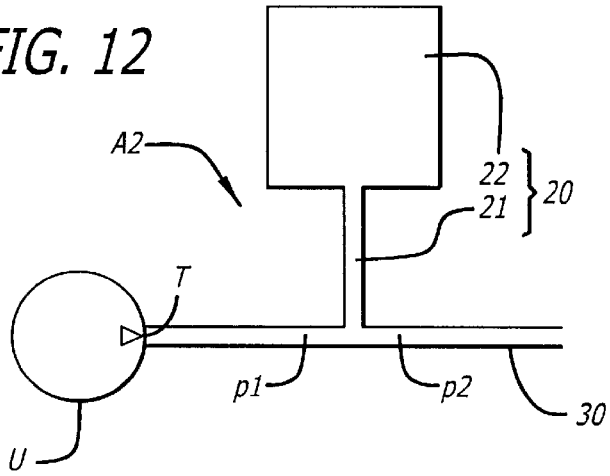
FIG. 13
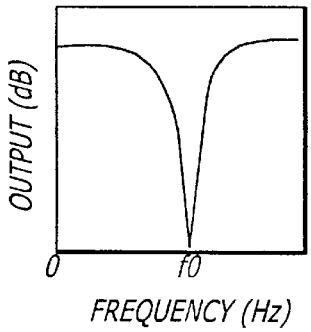

AXIAL PISTON PUMP

BACKGROUND OF THE INVENTION

1. Field of the Invention

The invention relates to an axial piston pump.

2. Description of the Related Art

An axial piston pump performs a pump action by receiving a fluid from a suction port into a piston chamber and discharging the fluid to a discharge port while relatively rotating a cylinder block with respect to a valving element. During this time, a fluctuation in pressure is caused in each of the piston chambers formed in the cylinder block. The fluctuation in the pressure acts as a vibromotive force on the pumping device and vibrates the pumping device. Consequently, noises are made. A process of the fluctuation in the pressure of one piston chamber includes a pressure rise process and a pressure drop process. If the pressure rapidly fluctuates in the pressure rise process and the pressure drop process, a pressure fluctuation curve includes many harmonic components. Consequently, the noises are particularly offensive to the ear.

There is an attempt to form a notch and a bypass port on a valving element in order to make the pressure fluctuation curve smooth in the pressure rise process and the pressure drop process (see Japanese Unexamined Patent Publication No. Sho 54-44208, for example). In an axial piston pump, a notch is formed continuously with respect to a discharge port, thereby making the pressure fluctuation curve in a piston chamber smooth in an early stage of the pressure rise process. The bypass port communicating with a suction port is formed on the valving element to make the pressure of the piston chamber escape to the suction port through the bypass port before the pressure of the piston chamber reaches that of the discharge port. Consequently, the pressure can be prevented from being rapidly raised in a late stage of the pressure rise process.

Moreover, a notch is formed continuously with respect to the suction port, thereby making the pressure fluctuation curve of the piston chamber smooth in an early stage of the pressure drop process. The bypass port communicating with the discharge port is formed in the valving element to lead the pressure of the discharge port to the piston chamber through the bypass port before the pressure of the piston chamber reaches that of the suction port. Thus, the pressure can be prevented from being rapidly dropped in a late stage of the pressure drop process.

As far as the pressure fluctuation curve of each of the piston chambers is concerned, it can be said that the above-mentioned structure can make the pressure fluctuation curve smoother. Pump noises, however, are made from all the pistons. Accordingly, even if the pressure fluctuation curve of each of the piston chambers is smooth, there are instances where the noises made by all the piston chambers include many harmonics.

SUMMARY OF THE INVENTION

It is an object of the invention not only to make a pressure fluctuation curve of each of piston chambers smooth, but also to regulate the mutual pressure rise and drop timing among the piston chambers, thereby decreasing harmonics of noises made by all the piston chambers.

In order to achieve the object, the invention provides an axial piston pump comprising a plurality of pistons, a cylinder block provided with a plurality of piston chambers in which the pistons slide, a valving element having a suction port and a discharge port formed therein, and a casing accommodating the cylinder block; the axial piston pump causing the pistons to reciprocate while relatively rotating the cylinder block with respect to the valving element, thereby receiving a fluid from the suction port into the piston chamber and discharging the fluid to the discharge port, the axial piston pump comprising a first opening portion formed in the valving element to be connected to the discharge port for making a pressure fluctuation curve of each of the piston chambers smooth in an early stage of a pressure rise process, a second opening portion formed in the valving element to be connected to at least one of the suction ports and an inside of the casing for making the pressure fluctuation curve of the piston chamber smooth in an early stage of a pressure drop process, a first bypass port formed on the valving element communicating with at least one of the suction ports and the inside of the casing, and a second bypass port formed on the valving element communicating with the discharge port, wherein during rotation of the cylinder block an opening of the first bypass port is positioned so as to start overlapping with an opening of the piston chamber before a pressure of the piston chamber reaches that of the discharge port after the opening of the piston chamber starts to overlap with the first opening portion, and an opening of the second bypass port is positioned so as to start overlapping with an opening of the piston chamber before a pressure of the piston chamber reaches that of the suction port after the opening of the piston chamber starts to overlap with the second opening portion, an opening of one of the piston chambers starts overlapping with the second opening portion when a pressure of another piston chamber substantially reaches that of the discharge port, and an opening of one of the piston chambers starts overlapping with the first opening portion when a pressure of the another piston chamber substantially reaches that of the suction port.

With such a structure, the pressure fluctuation curve in the pressure rise process and the pressure drop process of each of the piston chambers becomes smooth. The completion point of the pressure rise process in one of the piston chambers overlaps with the start point of the pressure drop process of another piston chamber. Furthermore, the completion point of the pressure drop process of one of the piston chambers overlaps with the start point of the pressure rise process of another piston chamber. Accordingly, the vibromotive forces generated by all the piston chambers resemble closely a sine-wave curve as a whole. Therefore, harmonic components included in noises are decreased. Accordingly, the harmonic components of the noises made from all the piston chambers can be decreased.

The axial piston pump may further comprise a swash plate such that the piston reciprocates according to an inclination of the swash plate. More specifically, the axial piston pump may be constituted as a swash plate-type axial piston pump.

In the axial piston pump, the pressure fluctuation curve of a piston chamber in the pressure rise process can be made substantially equal to a sine-wave curve from a local minimum; to a local maximum, and the pressure fluctuation curve of the piston chamber in the pressure drop process is substantially equal to a sinewave curve from a local maximum to a local minimum.

In order to achieve the object, furthermore, the invention provides an axial piston pump comprising a plurality of pistons, a cylinder block provided with a plurality of piston chambers in which the pistons slide, a valving element having a suction port and a discharge port formed therein, and a casing accommodating the cylinder block, the axial piston pump causing the pistons to reciprocate while relatively rotating the cylinder block with respect to the valving element, thereby receiving a fluid from the suction port into the piston chambers and discharging the fluid to the discharge port, the axial piston pump comprising a first opening portion formed on the valving element to be connected to the discharge port for making a pressure fluctuation curve of each of the piston chambers smooth in an early stage of a pressure rise process, a second opening portion formed on the valving element connected to at least one of the suction ports and an inside of the casing for making the pressure fluctuation curve of the piston chamber smooth in an early stage of a pressure drop process, a first bypass port formed on the valving element communicating with at least one of the suction ports and the inside of the casing, and a second bypass port formed on the valving element communicating with the discharge port, wherein as the cylinder block turns an opening of the piston chamber overlaps with the first opening portion, an opening of the first bypass port, the second opening portion and an opening of the second bypass port in such a manner that the pressure fluctuation curves in the pressure rise process and the pressure drop process of the piston chambers substantially make a sine-wave curve.

With such a structure, the vibromotive forces generated by all the piston chambers approximate a sine-wave curve as a whole. Thereby, harmonic components included in noises are decreased. Accordingly, the harmonic components of the noises made from all the piston chambers can be decreased.

The axial piston pump may further comprise a swash plate in such a manner that the piston reciprocates according to an inclination of the swash plate. More specifically, the axial piston pump may be constituted as a swash plate-type axial piston pump.

In the axial piston pump, a pressure of the piston chamber which accommodates the piston positioned at bottom dead center can be set on substantially a middle point of the pressure rise process, and a pressure of the piston chamber which accommodates the piston positioned at a top dead center can be set on substantially a middle point of the pressure drop process.

The pressure of each of the piston chambers acts as moment force for changing an angle of inclination of the swash plate. According to such a structure, the moment force can be offset during one rotation of the cylinder block. In the axial piston pump, the openings of the piston chambers can be arranged at intervals of equal angles. By the above-mentioned structure, therefore, pump control force can be prevented from being generated.

In the axial piston pump, a pulsation absorber can be provided on a piping system extending from the discharge port. In this case, particularly, a value obtained by multiplying a rated rotating speed of the pump by the number of pistons can be substantially equal to a minimum frequency which is an absorbing object of the pulsation absorber. By removing a primary frequency component of pulsations sent from the discharge port by means of the pulsation absorber, noises can further be reduced.

Furthermore, the pulsation absorber can be constituted as a closed pipe branching from the discharge port and can be of a Helmholtz-type. Such a pulsation absorber has a simple structure and a small size and requires a small installation space, as well as removes the primary frequency component of the pulsation sent from the discharge port, and can thereby reduce the noises.

These objects as well as other objects, features and advantages of the invention will become more apparent to those skilled in the art from the following description, with reference to the accompanying drawings.

DESCRIPTION OF THE DRAWINGS

FIG. 4A is a view showing the relationship of arrangement of the openings of the piston chambers with respect to the suction port and the discharge port on the sliding face when one of the openings is positioned 10 degrees short of a bottom dead center by;

FIG. 6 is a chart showing the pressure fluctuation curve of the piston chamber;

FIG. 9A is a chart showing a result of measuring of a pressure pulsation waveform of the discharge pressure of the discharge port in an axial piston pump according to an embodiment of the invention;

FIG. 9B is a chart showing a result of measuring of a pressure pulsation waveform of the discharge pressure of the discharge port in an axial piston pump according to the prior art;

FIG. 10 is a schematic view showing the structure of an axial piston pump according to another embodiment of the invention;

FIG. 11 is a characteristic chart showing the output characteristics of a pulsation absorber having a closed pipe structure;

FIG. 12 is a schematic view showing the structure of an axial piston pump according to yet another embodiment of the invention;

FIG. 13 is a characteristic chart showing the output characteristics of a Helmholtz type pulsation absorber.

DETAILED DESCRIPTION OF THE INVENTION

Figure 1:
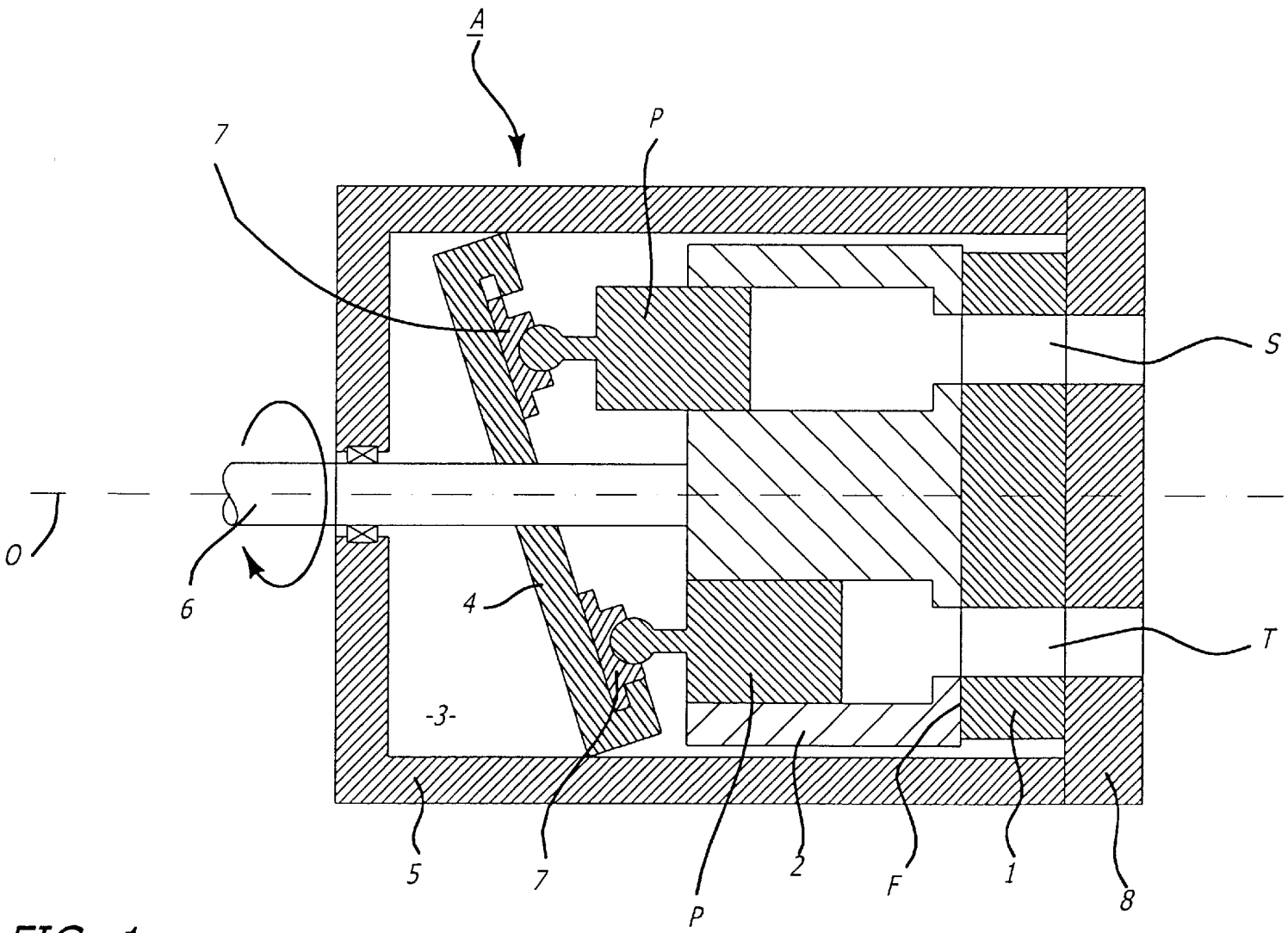
FIG. 1 is a longitudinally sectional view typically showing the structure of a rotary swash plate type axial piston pump according to an embodiment of the invention.

An embodiment of the invention will be described below with reference to the drawings. FIG. 1 is a longitudinal sectional view showing the structure of a typically swash plate type axial piston pump A. When a rotary shaft 6 rotates around a central axis O, a cylinder block 2 accommodated in a casing 5 rotates, and a piston P reciprocates and slides in a piston chamber formed in the cylinder block 2. In other words, a shoe 7 supporting one of ends of a rod of the piston P slides and rotates over a swash plate 4, and thereby the piston P reciprocates according to an inclination of the swash plate 4. A valving element cover 8 is fixed to an end of the casing 5. A valving element 1 is fixed to the valving element cover 8 in the casing 5. The valving element 1 has a suction port S and a discharge port T formed thereon. The valving element 1 and the cylinder block 2 are in contact with each other on a sliding face F. When the cylinder block 2 is relatively rotated with respect to the valving element 1, the valving element 1 and the cylinder block 2 mutually slide on the sliding face F. Consequently, a fluid is sucked from the suction port S into the piston chamber, and is discharged to the discharge port T. A space in the casing 5 is connected to a tank (not shown) through a drain port (not shown).

Figure 2A:
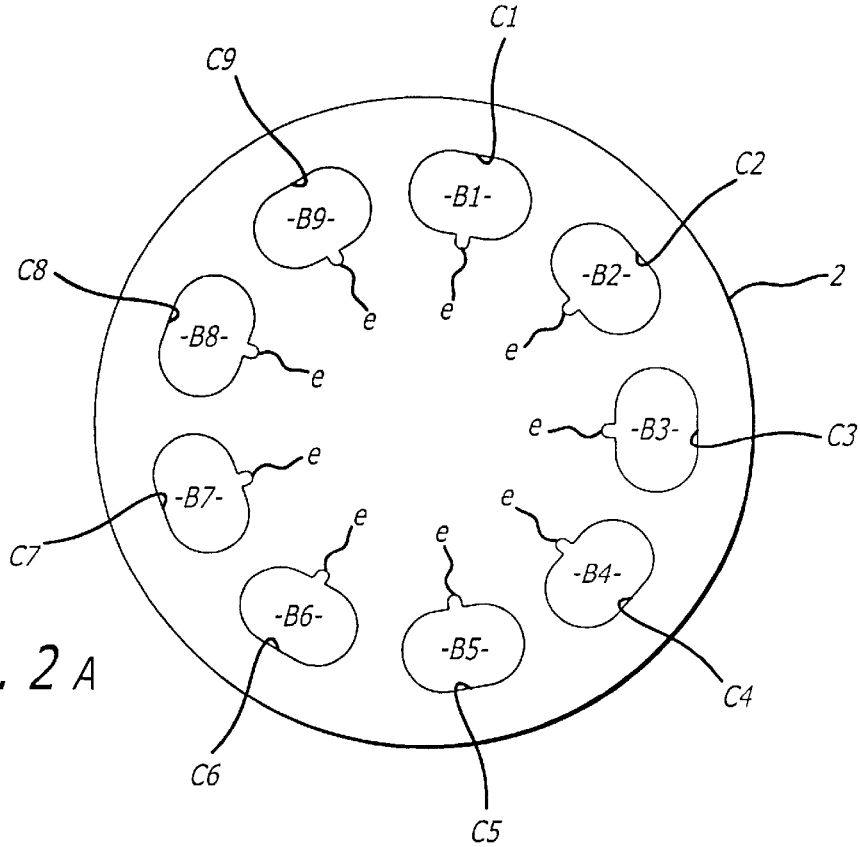
FIG. 2A is a view showing the relationship of the arrangement of the openings of the piston chambers on the sliding face.
Figure 2B:
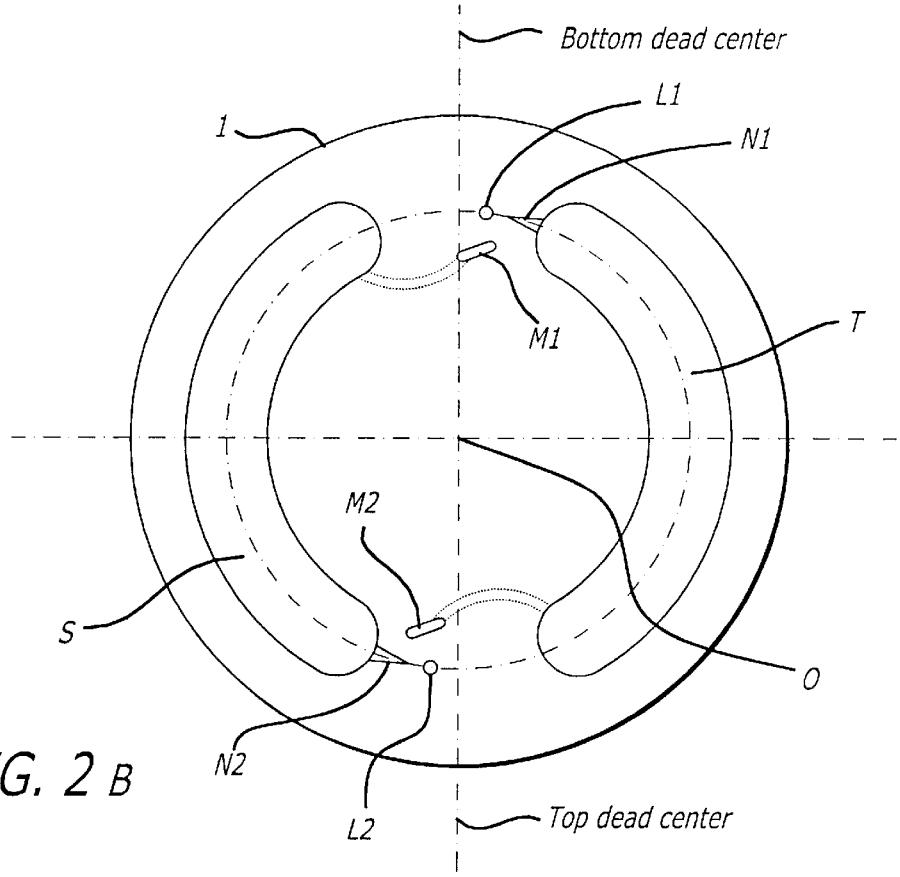
FIG. 2B is a view showing the relationship of the arrangement of the suction port and the discharge port on the sliding face.

FIGS. 2A and 2B are views showing the state of arrangement of openings C1 to C9 of the piston chamber, the suction port S, the discharge port T and the like on the sliding face F.

FIG. 2A shows the relationship of the arrangement of the openings C1 to C9 of the piston chamber on the sliding face F. The cylinder block 2 is provided with nine piston chambers B1 to B9, and the openings C1 to C9 corresponding to the piston chambers B1 to B9 are provided on the sliding face F at intervals of equal angles (40 degrees). The openings C1 to C9 have substantially elliptical shapes, and a notch e is formed on a part of a periphery thereof.

FIG. 2B shows the relationship of the arrangement of the suction port S, the discharge port T and the like on the sliding face F. The valving element 1 is provided with a first notch N1, a first conduit L1, a second notch N2 and a second conduit L2, whose openings are formed on the sliding face F. In the present embodiment, the first notch N1 and the first conduit L1 constitute a first opening portion, and the second notch N2 and the second conduit L2 constitute a second opening portion. As the first opening portion, the notch N1 may be not formed but only the conduit L1 may be formed, and the conduit L1 may be not formed but only the notch N1 may be formed. As the second opening portion, the notch N2 may be not formed but only the conduit L2 may be formed, and the conduit L2 may be not formed but only the notch N2 may be formed.

The opening of the notch N1 on the sliding face F is formed continuously with the opening of the discharge port T on the sliding face F. Thus, the notch N1 is connected to the discharge port T. The conduit L1 is formed to communicate with the discharge port T in the valving element 1. Thus, the conduit L1 is connected to the discharge port T. The opening of the conduit L1 is provided in the vicinity of a tip of the notch N1 on the sliding face F. The opening of the notch N2 on the sliding face F is formed continuously with the opening of the suction port S on the sliding face F. Thus, the notch N2 is connected to the suction port S. The conduit L2 is formed to communicate with the suction port S in the valving element 1. Thus, the conduit L2 is connected to the suction port S. The opening of the conduit L2 is provided in the vicinity of a tip of the notch N2 on the sliding face F.

Furthermore, the valving element 1 has a first bypass port M1 and a second bypass port M2 formed therein. The bypass port M1 is opened on the sliding face F and communicates with the suction port S in the valving element 1. The bypass port M2 is opened on the sliding face F and communicates with the discharge port T in the valving element 1.

In the drawing, a line extending upward from the central axis O is indicated as a "bottom dead center". This means that the piston P sliding in one of the piston chambers B is positioned on the bottom dead center in the said piston chamber when a central point of the opening of the said piston chamber is coincident with the line. Similarly, a line extending downward from the central axis O is indicated as a "top dead center". This means that the piston P sliding in one of the piston chambers B is positioned on the top dead center in the said piston chamber when a central point of the opening of the said piston chamber is coincident with the line.

Figure 3A:
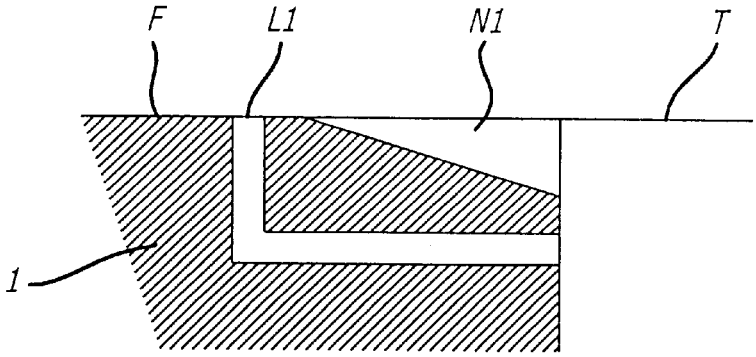
FIG. 3A is a partially sectional view showing the valving element on the periphery of a notch and a conduit.
Figure 3B:
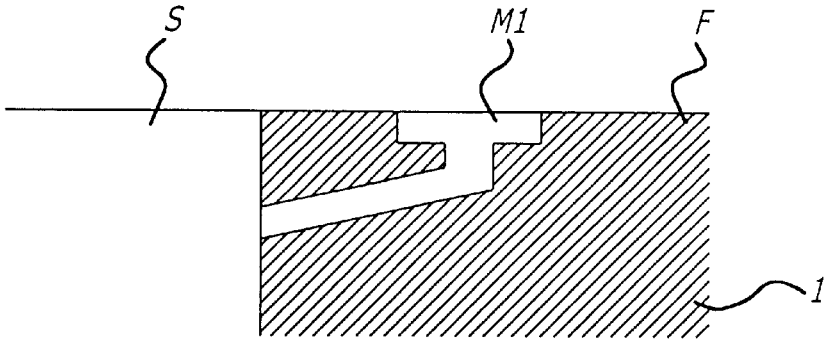
FIG. 3B is a partially sectional view showing the valving element on the periphery of a bypass port.

FIGS. 3A and 3B are partial sectional views showing the valving element 1. FIG. 3A shows a section of the valving element 1 on the periphery of the notch N1 and the conduit L1. FIG. 3B shows a section of the valving element 1 on the periphery of the bypass port M1.

As is apparent from FIG. 3A, the notch N1 is connected to the discharge port T on the sliding face F and the conduit L1 is connected to the discharge port T in the valving element 1. The notch N2 and the conduit L2 are also connected to the suction port S in the same manner. As is apparent from FIG. 3B, the bypass port M1 communicates with the suction port S in the valving element 1. The bypass port M2 also communicates with the discharge portT in the same manner.

Figure 4A:
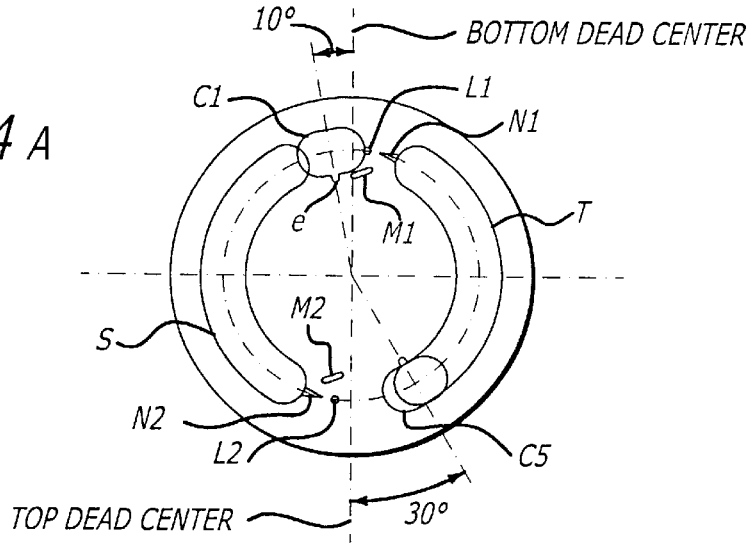
Figure 4B:
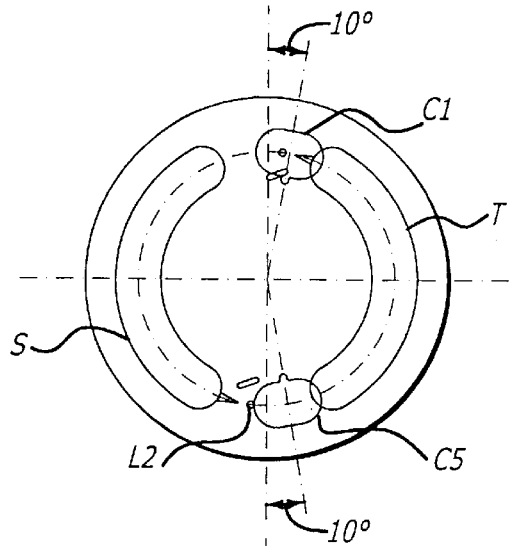
FIG. 4B is a view showing the relationship of arrangement of the openings of the piston chambers with respect to the suction port and the discharge port on the sliding face when a rotation angle of a cylinder block advances clockwise by 20 degrees from the state of FIG. 4A.
Figure 4C:
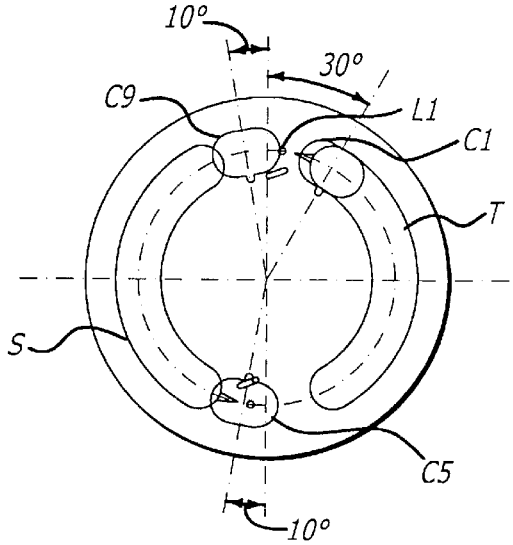
FIG. 4C is a view showing the relationship of arrangement of the openings of the piston chambers with respect to the suction port and the discharge port on the sliding face when the rotation angle of the cylinder block advances clockwise by additional 20 degrees from the state of FIG. 4B.

FIGS. 4A, 4B and 4C are views showing the state of arrangement of the suction port S, the discharge port T, the openings C1 and C5 and the like on the sliding face F. FIG. 4A shows a state in which the opening C1 is positioned 10 degrees short of the bottom dead center. FIG. 4B shows a state in which a rotation angle of the cylinder block 2 advances clockwise by 20 degrees from the state of FIG. 4A, thereby the opening C1 advances from the bottom dead center by 10 degrees. FIG. 4C shows a state in which the rotation angle of the cylinder block 2 advances clockwise by additional 20 degrees from the state of FIG. 4B, thereby the opening C1 advances from the bottom dead center by 30 degrees.

Figure 5:
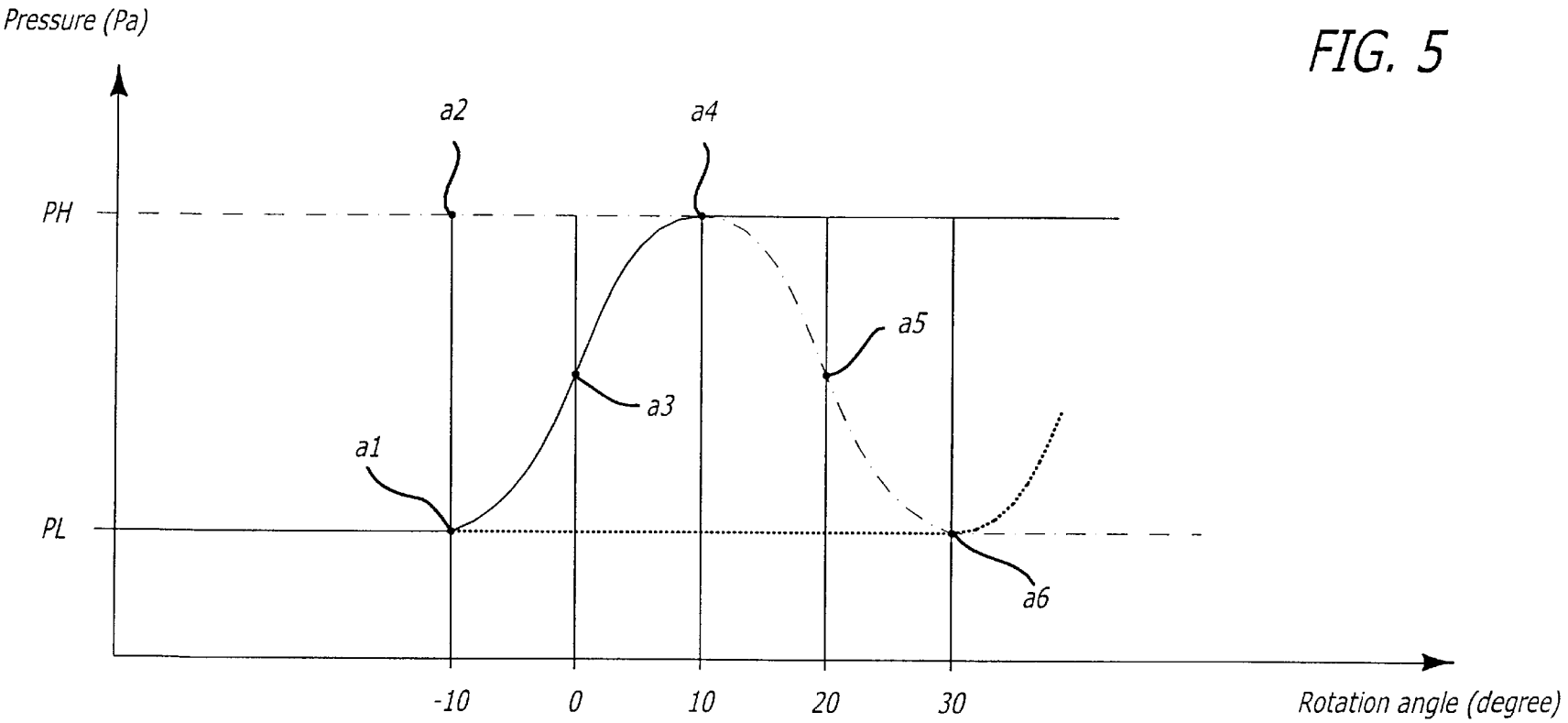
FIG. 5 is a chart showing a pressure fluctuation curve of the piston chamber.

FIG. 5 shows a pressure fluctuation curve of the piston chambers B1, B5 and B9 corresponding to the openings C1, C5 and C9. An axis of abscissa indicates a rotation angle of the opening C1 based on the bottom dead center. An axis of ordinate indicates a pressure value. PL on the axis of ordinate indicates a pressure value of the suction port S, and PH on the axis of ordinate indicates a pressure value of the discharge port T. With reference to these drawings, description will be given to the relationship between the positions of the openings C1, C5 and C9 and the pressures of the piston chambers B1, B5 and B9.

FIG. 4A shows a state in which the opening C1 is positioned 10 degrees short of the bottom dead center. The opening C1 rotates clockwise in FIG. 4A with respect to the suction port S and the discharge port T according to the rotation of the cylinder block 2, and the opening C5 also rotates clockwise around the central axis O. In the state of FIG. 4A, an end of the opening C1 approaches the conduit L1 provided in the vicinity of a tip of the notch N1. Accordingly, this state is set to a start point of the pressure rise process of the piston chamber B1 corresponding to the opening C1. In FIG. 5, the pressure of the piston chamber B1 is shown in a solid line. The pressure of the piston chamber B1 in the state of FIG. 4A is indicated as a point al in FIG. 5.

In the state shown in FIG. 4A, the opening C5 is positioned 30 degrees short of the top dead center and the pressure of the piston chamber B5 is coincident with the pressure value PH of the discharge port T. In FIG. 5, the pressure of the piston chamber B5 is shown in a one-dotted dashed line. The pressure of the piston chamber B5 in the state of FIG. 4A is indicated as a point a2 in FIG. 5.

If the openings C1 and C5 rotate clockwise by 10 degrees from the state of FIG. 4A, the opening C1 reaches the bottom dead center. At this time, the pressure of the piston chamber B1 has a mean value of PH and PL indicated as a point a3 in FIG. 5. Furthermore, when the opening C1 rotates clockwise, the notch e of the opening C1 overlaps with the bypass port M1, thereby the pressure of the piston chamber B1 is made to escape to the suction port S. Consequently, the pressure of the piston chamber B1 is prevented from rapidly reaching PH. Thus, the pressure fluctuation curve becomes smooth in a late stage of the pressure rise process.

As shown in FIG. 4B, when the opening C1 advances from the bottom dead center by 10 degrees, the pressure of the piston chamber B1 reaches PH. The pressure of the piston chamber at this time is indicated as a point a4 in FIG. 5.

Thus, the pressure rise process of the piston chamber B1 is completed. As is apparent from FIG. 5, the pressure fluctuation curve in the pressure rise process of the piston chamber B1 is a smooth curve which is substantially coincident with a sine-wave curve from a local minimum to a local maximum. The smooth curve can be obtained by the action of the conduit L1, the notch N1 and the bypass port Ml.

On the other hand, in the state shown in FIG. 4B, the opening C5 is positioned 10 degrees short of the top dead center and an end of the opening C5 approaches the conduit L2 provided in the vicinity of a tip of the notch N2. Accordingly, this state is set to a start point of the pressure drop process of the piston chamber B5 corresponding to the opening C5. The pressure of the piston chamber B5 in the state of FIG. 4B is indicated as a point a4 in FIG. 5. If the openings C1 and C5 rotate clockwise by 10 degrees from the state of FIG. 4B, the opening C5 reaches the top dead center. At this time, the pressure of the piston chamber B5 has a mean value of PH and PL indicated as a point a5 in FIG. 5. When the opening C5 further rotates clockwise, a notch e of the opening C5 overlaps with the bypass port M2, thereby the pressure of the discharge port T is led to the piston chamber B5. Consequently, the pressure of the piston chamber B5 is prevented from rapidly reaching PL. Thus, the pressure fluctuation curve becomes smooth in a late stage of the pressure drop process.

When the opening C5 advances from the top dead center by 10 degrees as shown in FIG. 4C, the pressure of the piston chamber B5 reaches PL. The pressure of the piston chamber B5 at this time is indicated as a point a6 in FIG. 5. Thus, the pressure drop process of the piston chamber B5 is completed. As is apparent from FIG. 5, the pressure fluctuation curve in the pressure drop process of the piston chamber B5 is a smooth curve which is substantially coincident with a sine-wave curve from a local maximum to a local minimum. The smooth curve can be obtained by the action of the conduit L2, the notch N2 and the bypass port M2.

In the state shown in FIG. 4C, the opening C9 adjacent to the opening C1 is positioned 10 degrees short of the bottom dead center and an end of the opening C9 approaches the conduit L1 provided in the vicinity of a tip of the notch N1.

Accordingly, this state is set to a start point of the pressure rise process of the piston chamber B9 corresponding to the opening C9. Subsequently, the same pressure rise process as the pressure rise process for the piston chamber B1 described above is carried out. A pressure fluctuation curve of the piston chamber B9 is shown in a broken line of FIG. 5.

As is apparent from FIG. 5, when the pressure fluctuation curve in the pressure rise process of the piston chamber B1 and the pressure fluctuation curve in the pressure drop process of the piston chamber B5 are joined together, they are substantially coincident with a sine-wave curve for one period which traces the points a1, a3, a4, a5 and a6 in sequence. By joining the pressure fluctuation curves in the pressure rise and drop processes for all the piston chambers B1 to B9 during one rotation of the cylinder block 2, accordingly, a sine-wave curve for nine periods are obtained. The fluctuation in the pressure of each of the piston chambers B1 to B9 acts as vibromotive force for vibrating the axial piston pump. Consequently, noises are made. The pressure fluctuation curves in the pressure rise and drop processes of the piston chambers B1 to B9, however, draw a continuous sine-wave curve as a whole. Accordingly, the noises do not include much harmonics, therefore the noises are not offensive to the ear.

FIG. 6 is a chart showing a fluctuation in the pressure of the piston chamber B1. An axis of abscissa indicates a rotation angle of the opening C1 to which the piston chamber B1 corresponds. The rotation angle is based on the bottom dead center. An axis of ordinate indicates a pressure of the piston chamber B1. PL on the axis of ordinate indicates a pressure of the suction port S and PH on the axis of ordinate indicates a pressure of the discharge port T. As is apparent from FIG. 6, the opening C1 is positioned at a point having a rotation angle of 0 degree substantially in the middle (a middle point) of the pressure rise process of the piston chamber B1. At this time, the piston in the piston chamber B1 is positioned on the bottom dead center. The opening C1 is positioned at a point having a rotation angle of+180 degrees substantially in the middle (a middle point) of the pressure drop process of the piston chamber B1. At this time, the piston in the piston chamber B1 is positioned on the top dead center. If the rotation angle of the opening C1 and the fluctuation in the pressure of the piston chamber B1 have such a relationship, the moment force which is caused by the pressure of the piston chamber B1 and acts to change an angle of inclination of the swash plate 4 is offset during one rotation of the cylinder block 2. A similar conclusion can be drawn about the piston chambers B2 to B9. The openings C1 to C9 are arranged at intervals of equal angles. Therefore, the moment force for the swash plate 4 which is caused by the pressure of each of the piston chambers B1 to B9 is wholly offset. Consequently, a pump control force is not generated.

Figure 7:
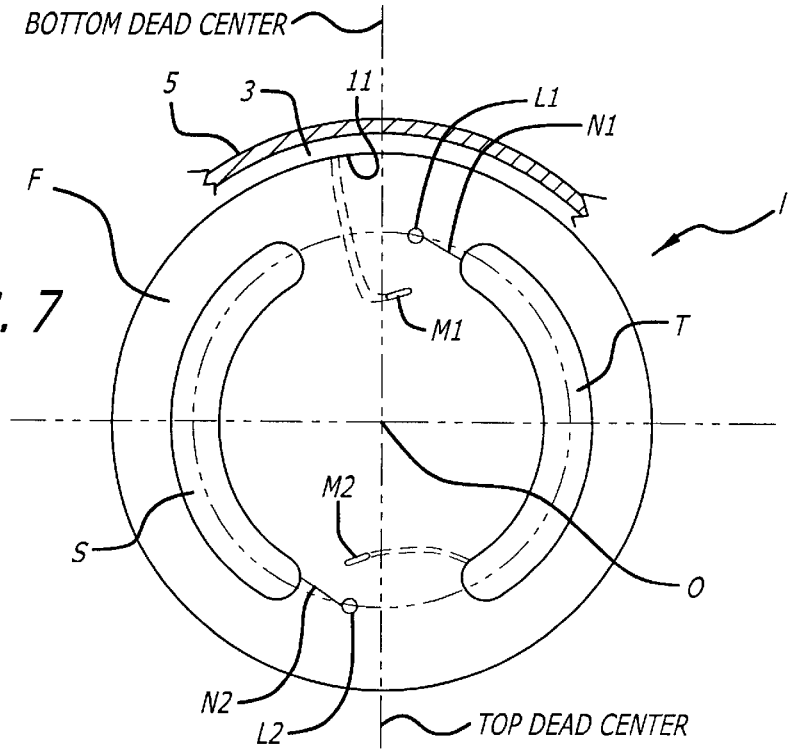
FIG. 7 is a view showing the relationship of the arrangement of the suction port, the discharge port and the like on the sliding face.

FIG. 7 is a view showing a state of arrangement of a suction port S, a discharge port T and the like on a sliding face F in an axial piston pump according to another embodiment of the invention. Also in this embodiment, a space 3 in a casing 5 is connected to a tank (not shown) through a drain port (not shown). In this embodiment, a bypass port M1 opening on the sliding face F does not communicate with the suction port S but with the space 3 in the casing 5 adjacent a side of a valving element 1. More specifically, the bypass port M1 opens on the sliding face F and an outer peripheral face 11 of the valving element 1. Other structures of the axial piston pump according to this embodiment are the same as those of the axial piston pump A according to the embodiment shown in FIGS. 1, 2A and 2B. With such a structure, pressure in each of piston chambers B1 to B9 is made to escape to an inside of the casing 5 before it reaches a pressure of the discharge port T in a pressure rise process. Consequently, the pressure of each of the piston chambers B1 to B9 can be prevented from rapidly reaching a pressure PH of the discharge port T. Thus, a pressure fluctuation curve can be made smooth in a late stage of the pressure rise process. Also in this embodiment, the pressure fluctuation curve becomes such a curve as shown in FIG. 5.

Figure 8:
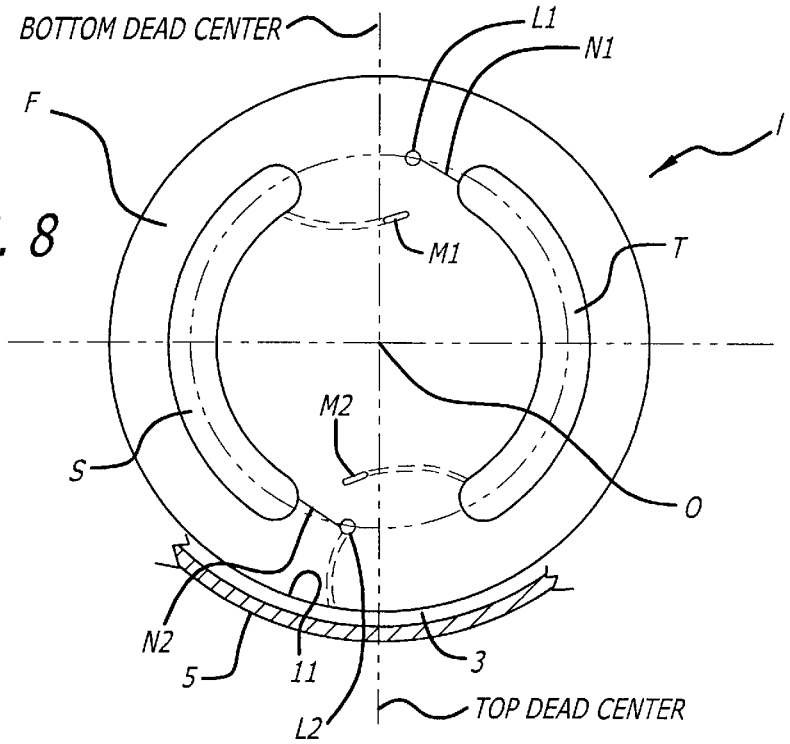
FIG. 8 is a view showing the relationship of the arrangement of the suction port, the discharge port and the like on the sliding face.

FIG. 8 is a view showing a state of arrangement of a suction port S, a discharge port T, and the like on a sliding face F in an axial piston pump according to yet another embodiment of the invention. Also in this embodiment, a space 3 in a casing 5 is connected to a tank (not shown) through a drain port (not shown). In this embodiment, a conduit L2 opening on the sliding face F does not communicate with the suction port S but with the space 3 in the casing 5 adjacent a side of a valving element 1. More specifically, the conduit L2 opens on the sliding face F and an outer peripheral face 11 of the valving element 1. Thus, the conduit L2 is connected to the space inside of the casing 5. Other structures of the axial piston pump according to this embodiment are the same as those of the axial piston pump A according to the embodiment shown in FIGS. 1, 2A and 2B. With such a structure, a time that an end of an opening of each of piston chambers B1 to B9 approaches the conduit L2 is set to a start point of a pressure drop process of each of the piston chambers B1 to B9. The pressure of the piston chamber is gradually made to escape to the inside of the casing 5 through the conduit L2. Consequently, a rapid drop in the pressure is prevented, thereby a pressure fluctuation curve in an early stage of the pressure drop process can be made smooth. Also in the present embodiment, the pressure fluctuation curve becomes such a curve as shown in FIG. 5.

FIGS. 9A and 9B are charts showing results of measurement of a discharge pressure of the discharge port T. FIG. 9A shows a pressure pulsation waveform of a discharge pressure in an axial piston pump A according to the invention, and FIG. 9B shows a pressure pulsation waveform of a discharge pressure in an axial piston pump according to the prior art.

As is apparent from FIG. 9A, the axial piston pump A according to the invention has a pressure pulsation waveform of the discharge pressure closer resembling a sine-wave curve when compared with the axial piston pump according to the prior art. As is apparent from the result of measurements, in the axial piston pump A according to the invention, noises made by a fluctuation in the discharge pressure of the discharge port T include less harmonic components, therefore they are not as offensive to the ear.

FIG. 10 illustrates an axial piston pump A1 according to a further embodiment of the invention. An axial piston pump A1 has a pump portion U having the same structure as the structure of the axial piston pump A according to the embodiment shown in FIGS. 1 to 6. Therefore, a pressure pulsation waveform of a discharge pressure of a discharge port T includes less harmonic components. The axial piston pump A1 further comprises a pulsation absorber 10. The pulsation absorber 10 is provided in a piping system 30 extending from the discharge port T. The pulsation absorber 10 is formed of a vertical closed pipe. The closed pipe is connected to branch from the piping system 30 like a branch pipe. The characteristics of the pulsation absorber 10 are substantially determined depending on a pipe length thereof.

FIG. 11 is a characteristic chart showing the output characteristics of the pulsation absorber 10 having a closed pipe structure. The characteristic chart shows a level of pressure pulsation which is output from an output side when the pressure pulsation whose component level is constant on a frequency axis is input from an input side of the pulsation absorber 10. Although the pressure pulsation acts as vibromotive force of a pump to make noises, a specific frequency component is absorbed by the pulsation absorber 10 as is apparent from FIG. 11. The pulsation absorber 10 produces not only pulsation absorbing effects for a fundamental frequency $f_1$ but also pulsation absorbing effects for frequencies of $3\times f_1$, $5\times f_1$, $7\times f_1$ . . . which are odd times as much as the fundamental frequency $f_1$. On the other hand, the pulsation absorber having the closed pipe structure is characterized in that the components of frequencies of $2\times f_1$, $4f_1$, $6f_1$. . . which are even times as much as the fundamental frequency $f_1$ tend to be amplified. The frequencies of $f_1 3\times f_1$, $5\times f_1$, $7\times f_1$ . . . are pulsation absorbing objects of the pulsation absorber 10. A minimum frequency $f_1$ (Hz) which is the pulsation absorbing object of the pulsation absorber 10 is substantially coincident with a value (R×N) which is obtained by multiplying a rated rotating speed R (rotation/second) of the axial piston pump A1 by a piston number N.

A pressure pulsation waveform of input side of the pulsation absorber 10 is a periodic waveform which has a period of 1/(R×N) and less harmonic components. By the action of the pulsation absorber 10, an R×N (Hz) component which is a primary frequency component and harmonic components which are odd times as much as the R×N (Hz) component are removed from the pressure pulsation waveform. As described above, the pulsation absorber having the closed pipe structure tends to amplify the components of the frequencies which are even times as much as the fundamental frequency. However, the pressure pulsation waveform on the input side of the pulsation absorber 10 originally includes less harmonic components. Therefore, if the primary frequency component can be removed, sufficient effects of reducing noises can be obtained.

Although some pulsation absorbers can have pulsation absorbing effects over a wide frequency range as in a pulse damper, for example, they are large-sized and require a large space for installation. On the other hand, the pulsation absorber having the closed pipe structure is small-sized and has a simple structure, and yet can remove primary frequency components. Therefore, sufficient pulsation absorbing effects can be obtained.

FIG. 12 is a view showing the structure of an axial piston pump according to a further embodiment of the invention. An axial piston pump A2 also has a pump portion U having the same structure as the structure of the axial piston pump A shown in FIGS. 1 to 6. Therefore, a pressure pulsation waveform of a discharge pressure of a discharge port T includes less harmonic components. The axial piston pump A2 also comprises a pulsation absorber 20. However, the pulsation absorber 20 has a different structure from the structure of the pulsation absorber 10 shown in FIG. 10, and is a Helmholtz-type pulsation absorber, that is, a resonator.

The pulsation absorber 20 includes a restriction 21 and a chamber 22. The chamber 22 communicates with a piping system 30 extending from a discharge port T past the restriction 21. The characteristics of the pulsation absorber 20 are substantially determined depending on the volume of the chamber 22.

FIG. 13 is a characteristic chart showing the output characteristics of the Helmholtz type pulsation absorber 20. The characteristic chart shows a level of pressure pulsation which is output from an output side when the pressure pulsation whose component level is constant on a frequency axis is input from an input side of the pulsation absorber 20. As is apparent from FIG. 13, the pulsation absorber 20 has pulsation absorbing effects for a fundamental frequency $f_0$ but does not have pulsation absorbing effects for other frequencies.

Only $f_0$ is a frequency which is a pulsation absorbing object of the pulsation absorber 20. Accordingly, $f_0$ is a minimum frequency which is a pulsation absorbing object. The frequency $f_0$ (Hz) is coincident with a value (R×N) obtained by multiplying a rated rotating speed R (rotation/second) of the axial piston pump A2 by a piston number N.

Figure 14A:
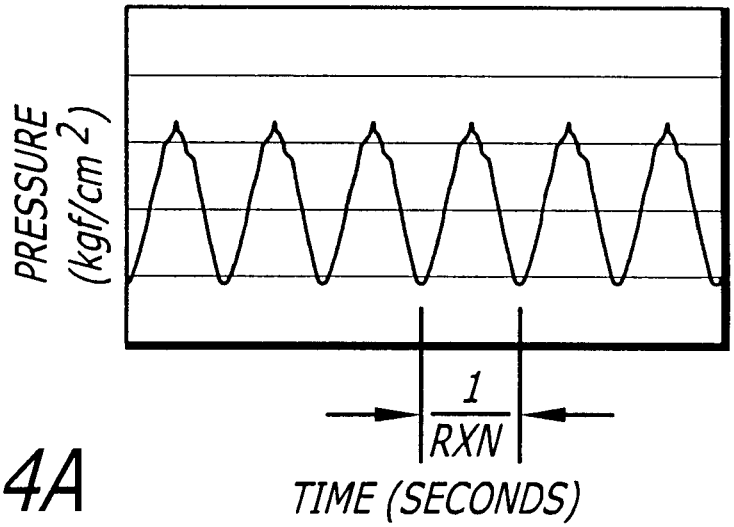
FIG. 14A is a view showing result of measurement of a pressure pulsation waveform at a point on an input side of the pulsation absorber connected to a piping system extending from a discharge port.
Figure 14B:
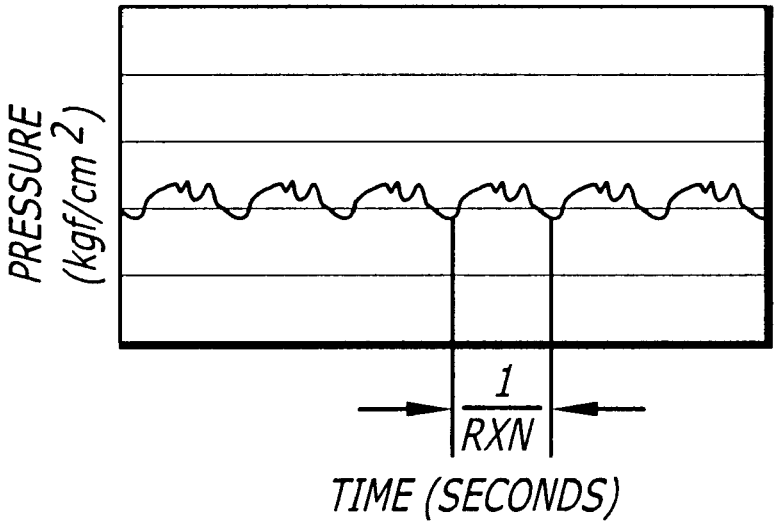
FIG. 14B is a view showing result of measurement of a pressure pulsation waveform at a point on an output side of the pulsation absorber connected to a piping system extending from a discharge port.

FIGS. 14A and 14B are charts showing results of measurement of an input-output pressure pulsation waveform of the pulsation absorber 20 connected to the piping system 30 extending from the discharge port T. FIG. 14A shows a pressure pulsation waveform obtained at a point p1 (see FIG. 12) on an input side of the pulsation absorber 20. FIG. 14B shows a pressure pulsation waveform obtained at a point p2 (see FIG. 12) on an output side of the pulsation absorber 20. In FIGS. 14A and 14B, an axis of ordinate indicates pressure and an axis of abscissa indicates time.

The pressure pulsation waveform shown in FIG. 14A is a periodic waveform having a period of 1/(R×N), and corresponds to the pressure pulsation waveform shown in FIG. 9A. It is apparent that the pressure pulsation waveform takes a shape closely resembling a sine wave having a frequency of R×N (Hz) and is constituted by a primary frequency component as the main component.

FIG. 14B shows a waveform in which the primary frequency component, that is, the (R×N) (Hz) component is mostly removed from the pressure pulsation waveform shown in FIG. 14A by the action of the pulsation absorber 20 and secondary and succeeding harmonic components are main components. Since the pressure pulsation waveform shown in FIG. 14A includes less harmonic components, the waveform shown in FIG. 14B has smaller amplitude. Although the Helmholtz-type pulsation absorber is small-sized as the pulsation absorber and has a simple structure, it can remove a primary frequency component. Therefore, an effect of reducing noise can be obtained.

Although the pulsation absorber having the closed pipe structure and the Helmholtz-type pulsation absorber have been shown as the pulsation absorber to be provided on a piping system extending from a discharge port in FIGS. 10 to 14A and 14B, pulsation absorbers having other structures can also be employed.

Various embodiments of the axial piston pump according to the invention have been described above. Although the valving element according to the invention means a block having a discharge port and a suction port formed thereon, it does not need to be constituted by only one member but may be constituted by the combination of a plurality of members.

Although the examples in which the invention is applied to the swash plate type axial piston pump have mainly been described above, the axial piston pump to which the invention is applied is not restricted to the swash plate type, but the invention can be applied to an inclined shaft type axial piston pump, for example.

Numerous modifications and alternative embodiments of the invention will be apparent to those skilled in the art in view of the foregoing description. Accordingly, this description is to be construed as illustrative only, and is provided for the purpose of teaching those skilled in the art the best mode of carrying out the invention. The details of the structure and/or function may be varied substantially without departing from the spirit of the invention.

We claim:

1. An axial piston pump comprising a plurality of pistons, a cylinder block provided with a plurality of piston chambers in which the pistons slide, a valving element having a suction port and a discharge port formed therein, and a casing accommodating the cylinder block, the axial piston pump causing the pistons to reciprocate while relatively rotating the cylinder block with respect to the valving element, thereby receiving a fluid from the suction port into the piston chamber and discharging the fluid to the discharge port, the axial piston pump comprising:

a first opening portion formed in the valving element connected to the discharge port configured for making a pressure fluctuation curve of each of the piston chambers smooth in an early stage of a pressure rise process, a second opening portion formed in the valving element to be connected to at least one of the suction port and an inside of the casing, for making the pressure fluctuation curve of the piston chamber smooth in an early stage of a pressure drop process, a first bypass port formed in the valving element communicating with at least one of the suction port and the inside of the casing, and a second bypass port formed in the valving element communicating with the discharge port, wherein an opening of the first bypass port is positioned so as to start overlapping with an opening of the piston chamber before a pressure of the piston chamber reaches that of the discharge port after the opening of the piston chamber starts to overlap with the first opening portion, an opening of the second bypass port is positioned at such a place as to start overlapping with an opening of the piston chamber before a pressure of the piston chamber reaches that of the suction port after the opening of the piston chamber starts to overlap with the second opening portion, an opening of one of the piston chambers starts overlapping with the second opening portion when a pressure of another piston chamber substantially reaches that of the discharge port, and an opening of one of the piston chambers starts overlapping with the first opening portion when a pressure of another piston chamber substantially reaches that of the suction port.

2. The axial piston pump according to claim 1, wherein a pressure fluctuation curve of the piston chamber in the pressure rise process is substantially a sine-wave curve from a local minimum to a local maximum, and a pressure fluctuation curve of the piston chamber in the pressure drop process is substantially a sine-wave curve from a local maximum to a local minimum.

3. The axial piston pump according to claim 1, wherein a pressure of a piston chamber which accommodates the piston positioned on a bottom dead center is set on substantially a middle point of the pressure rise process, and a pressure of a piston chamber which accommodates the piston positioned on a top dead center is set on substantially a middle point of the pressure drop process.

4. The axial piston pump according to claims 1, further comprising a piping system extending from the discharge port wherein a pulsation absorber is provided on the piping system extending from the discharge port.

5. An axial piston pump comprising a swash plate, a plurality of pistons, a cylinder block provided with a plurality of piston chambers in which the pistons slide, a valving element having a suction port and a discharge port formed therein, and a casing accommodating the cylinder block, the axial piston pump causing the pistons to reciprocate according to an inclination of the swash plate while relatively rotating the cylinder block with respect to the valving element, thereby receiving a fluid from the suction port into the piston chambers and discharging the fluid to the discharge port, the axial piston pump comprising:

a first opening portion formed in the valving element connected to the discharge port for making a pressure fluctuation curve of each of the piston chambers smooth in an early stage of a pressure rise process, a second opening portion formed in the valving element to be connected to at least one of the suction port and an inside of the casing, for making the pressure fluctuation curve of the piston chamber smooth in an early stage of a pressure drop process, a first bypass port formed in the valving element communicating with the suction port or the inside of the casing, and a second bypass port formed in the valving element communicating with the discharge port, wherein an opening of the first bypass port is positioned so as to start overlapping with an opening of the piston chamber before a pressure of the piston chamber reaches that of the discharge port after the opening of the piston chamber starts to overlap with the first opening portion, an opening of the second bypass port is positioned so as to start overlapping with an opening of the piston chamber before a pressure of the piston chamber reaches that of the suction port after the opening of the piston chamber starts to overlap with the second opening portion, an opening of one of the piston chambers starts overlapping with the second opening portion when a pressure of another piston chamber substantially reaches that of the discharge port, and an opening of one of the piston chambers starts overlapping with the first opening portion when a pressure of another piston chamber substantially reaches that of the suction port.

6. The axial piston pump according to claim 5, wherein a pressure fluctuation curve of the piston chamber in the pressure rise process is substantially a sine-wave curve from a local minimum to a local maximum, and a pressure fluctuation curve of the piston chamber in the pressure drop process is substantially a sine-wave curve from a local maximum to a local minimum.

7. The axial piston pump according to claim 5, wherein a pressure of a piston chamber which accommodates the piston positioned on a bottom dead center is set on substantially a middle point of the pressure rise process, and a pressure of a piston chamber which accommodates the piston positioned on a top dead center is set on substantially a middle point of the pressure drop process.

8. The axial piston pump according to claim 5, further comprising a piping system extending from the discharge port wherein a pulsation absorber is provided on the piping system extending from the discharge port.

9. An axial piston pump comprising a plurality of pistons, a cylinder block provided with a plurality of piston chambers in which the pistons slide, a valving element having a suction port and a discharge port formed therein, and a casing accommodating the cylinder block, the axial piston pump causing the pistons to reciprocate while relatively rotating the cylinder block with respect to the valving element, thereby receiving a fluid from the suction port into the piston chambers and discharging the fluid to the discharge port, the axial piston pump comprising:

a first opening portion formed in the valving element connected to the discharge port for making a pressure fluctuation curve of each of the piston chambers smooth in an early stage of a pressure rise process, a second opening portion formed in the valving element to be connected to at least one of the suction port and an inside of the casing, for making the pressure fluctuation curve of the piston chamber smooth in an early stage of a pressure drop process, a first bypass port formed in the valving element communicating with the suction port or the inside of the casing, and a second bypass port formed on the valving element communicating with the discharge port, wherein during rotation of the cylinder block an opening of each piston chamber overlaps with the first opening portion, an opening of the first bypass port, the second opening portion and an opening of the second bypass port in such a manner that pressure fluctuation curves in the pressure rise process and the pressure drop process of the piston chambers substantially follow a sine-wave curves in all the piston chambers.

10. The axial piston pump according to claim 9, wherein a pressure of a piston chamber which accommodates the piston positioned on a bottom dead center is set on substantially a middle point of the pressure rise process, and a pressure of a piston chamber which accommodates the piston positioned on a top dead center is set on substantially a middle point of the pressure drop process.

11. The axial piston pump according to claim 9, further comprising a piping system extending from the discharge port wherein a pulsation absorber is provided on the piping system extending from the discharge port.

12. An axial piston pump comprising a swash plate, a plurality of pistons, a cylinder block provided with a plurality of piston chambers in which the pistons slide, a valving element having a suction port and a discharge port formed therein, and a casing accommodating the cylinder block, the axial piston pump causing the pistons to reciprocate according to an inclination of the swash plate while relatively rotating the cylinder block with respect to the valving element, thereby receiving a fluid from the suction port into the piston chambers and discharging the fluid to the discharge port, the axial piston pump comprising:

a first opening portion formed in the valving element to be connected to the discharge port for making a pressure fluctuation curve of each of the piston chambers smooth in an early stage of a pressure rise process, a second opening portion formed in the valving element to be connected to at least one of the suction port and an inside of the casing, making the pressure fluctuation curve of the piston chamber smooth in an early stage of a pressure drop process, a first bypass port formed on the valving element communicating with at least one of the suction ports and the inside of the casing, and a second bypass port formed on the valving element communicating with the discharge port, wherein during rotation of the cylinder block an opening of the piston chamber overlaps with the first opening portion, an opening of the first bypass port, the second opening portion and an opening of the second bypass port in such a manner that the pressure fluctuation curves in the pressure rise process and the pressure drop process of the piston chambers substantially make a sine-wave curve in all the piston chambers.

13. The axial piston pump according to claim 12, wherein a pressure of a piston chamber which accommodates the piston positioned on a bottom dead center is set on substantially a middle point of the pressure rise process, and a pressure of a piston chamber which accommodates the piston positioned on a top dead center is set on substantially a middle point of the pressure drop process.

14. The axial piston pump according to claim 12, further comprising a piping system extending from the discharge port wherein a pulsation absorber is provided on the piping system extending from the discharge port.

15. The axial piston pump according to claim 14, wherein a value obtained by multiplying a rated rotating speed by a number of pistons is substantially equal to a minimum frequency which is an absorbing object of the pulsation absorber.

16. The axial piston pump according to claim 14, wherein the pulsation absorber is a closed pipe branching from the discharge port.

17. The axial piston pump according to claim 14, wherein the pulsation absorber is of a Helmholtz-type.

* * * * *